US005444944A

United States Patent [19]

Roelofsz

[11] Patent Number: 5,444,944

[45] Date of Patent: Aug. 29, 1995

[54] LOW COST COLLAPSIBLE ENCLOSURE

[76] Inventor: Malcolm J. C. Roelofsz, P.O. Box 360 Umhlanga Rocks, 4320 Natal, South Africa

[21] Appl. No.: 111,450

[22] Filed: Aug. 25, 1993

[30] Foreign Application Priority Data

Aug. 25, 1992 [ZA] South Africa ..... 92/1344

[51] Int. Cl.[6] ..... E04H 1/00

[52] U.S. Cl. ..... 52/64; 52/69; 52/79.5; 52/71; 52/91.1

[58] Field of Search ..... 52/64, 69, 71, 79.5, 52/91.1

[56] References Cited

U.S. PATENT DOCUMENTS

| | | | |
|---|---|---|---|
| 2,592,610 | 4/1952 | Shumaker | 52/69 |
| 2,751,635 | 6/1956 | Donnahue | 52/69 |
| 2,765,498 | 10/1956 | Kelnhofer | 52/71 X |
| 3,012,291 | 12/1961 | Rice | 52/69 |
| 3,093,259 | 6/1963 | Morrison | 52/64 X |
| 3,983,665 | 10/1976 | Burton | 52/79.5 |
| 3,984,948 | 10/1976 | Bussard | 52/69 |
| 4,112,635 | 9/1978 | Rylander | 52/69 |
| 4,240,646 | 12/1980 | Scott | 52/69 |
| 4,633,626 | 1/1987 | Freeman | 52/71 |
| 4,891,919 | 1/1990 | Palibroda | 52/79.5 |

*Primary Examiner*—Carl D. Friedman
*Assistant Examiner*—Beth A. Aubrey
*Attorney, Agent, or Firm*—Young & Thompson

[57] ABSTRACT

A unit for an enclosure such as a container or a housing unit, kiosk or the like includes base elements of progressively increased heights, each base element having a wall hinged thereto, the walls being foldable into a compact item which is easily transportable and which is unfolded into a container which is secured by pin and socket formations in a roof member and peripheral angle irons which also include panels.

7 Claims, 4 Drawing Sheets

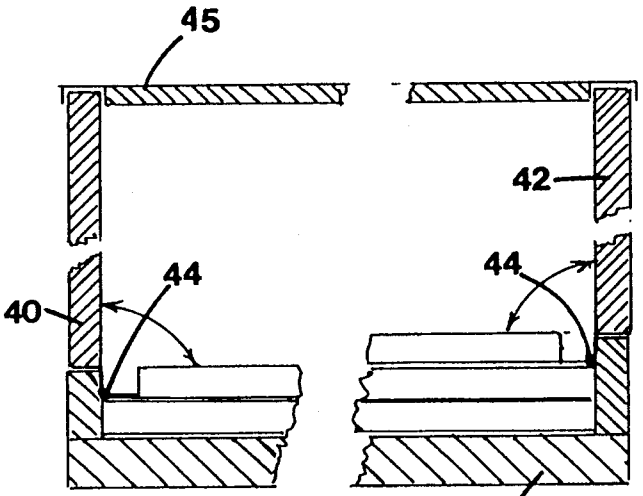
FIG 7
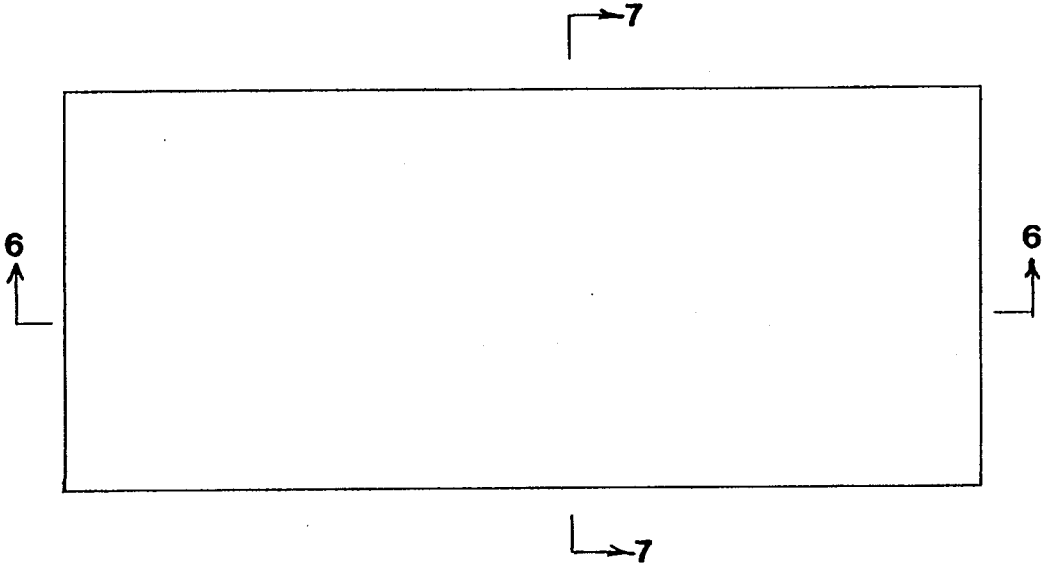
FIG 5
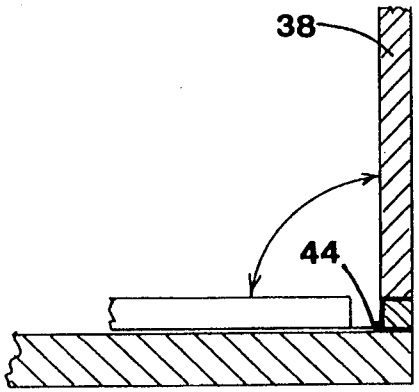
FIG 6
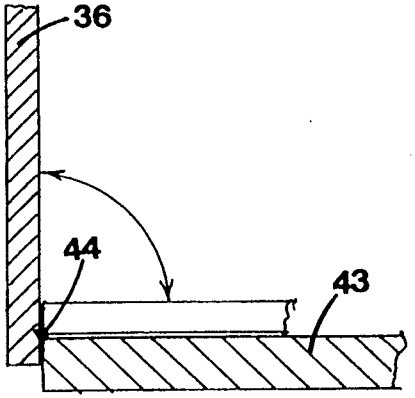

LOW COST COLLAPSIBLE ENCLOSURE

FIELD OF THE INVENTION

This invention relates to a low cost collapsible enclosure. In one form of the invention the enclosure is a container for transport of goods and in another form of the invention the enclosure is a low cost building which can be used for a variety of purposes, such as a low cost hut, cubicle, shed, kiosk or the like.

BACKGROUND OF THE INVENTION

The need for very low cost accommodation has never been more needed and it is the prime object of this invention to provide a unit which is not only very inexpensive but which is also very easily erected so that unskilled labour can be employed.

In addition the unit is erectable in a matter of minutes unlike other suggestions for low cost housing. This rapidity of erection makes it ideal for kiosks and other hut types, which are required to be erected and later removed from site, such as a kiosk or a building site hut, for example.

As far as containerism is concerned, one of the main disadvantages at present is the transportation of empty containers which take the same volume as full containers and are non-profitable.

It is an object of the present invention to provide a container which does not suffer from this disadvantage and which can also be used as a temporary (or permanent) accommodation. A further object of the invention is the provision of extremely inexpensive accommodation which is erectable by unskilled labour.

SUMMARY OF THE INVENTION

According to the invention a unit for an enclosure includes base elements of differing heights and having walls hinged thereto in overlapping relationship in their horizontal position and means to secure the walls in an enclosure-forming position.

In a preferred form of the invention the base elements differ in height from each other in accordance with the thickness of the walls. If all the walls are of the same thickness the base elements will increase progressively in height.

The walls may include openings for windows and doors and it will be appreciated that two or more enclosures may be erected in abutment to constitute an enclosure (building) of a plurality of units. In this case one or more of the walls may be omitted from one or more of the units so as to provide free access between adjacent units.

The erected walls may be secured in a number of possible ways depending on the nature of the materials used. In one form of the invention the walls have edges of channel section and these can be secured by means of pins depending from a roofing member, thereby effecting both the securing operation and the attachment of the roof. It will be appreciated that insulation and sealing strips may be provided.

Metal door and window frames may be welded into the wall frames and a wide variety of designs is possible.

BRIEF DESCRIPTION OF THE DRAWINGS

Embodiments of the invention are described below with reference to the accompanying drawings in which:

FIG. 5 is a plan view of a container according to the invention;

FIG. 6 is a sectional view along lines 6—6 of FIG. 5;

FIG. 7 is a sectional view along lines 7—7 of FIG. 5; and

DESCRIPTION OF THE PREFERRED EMBODIMENT

Figure 1:
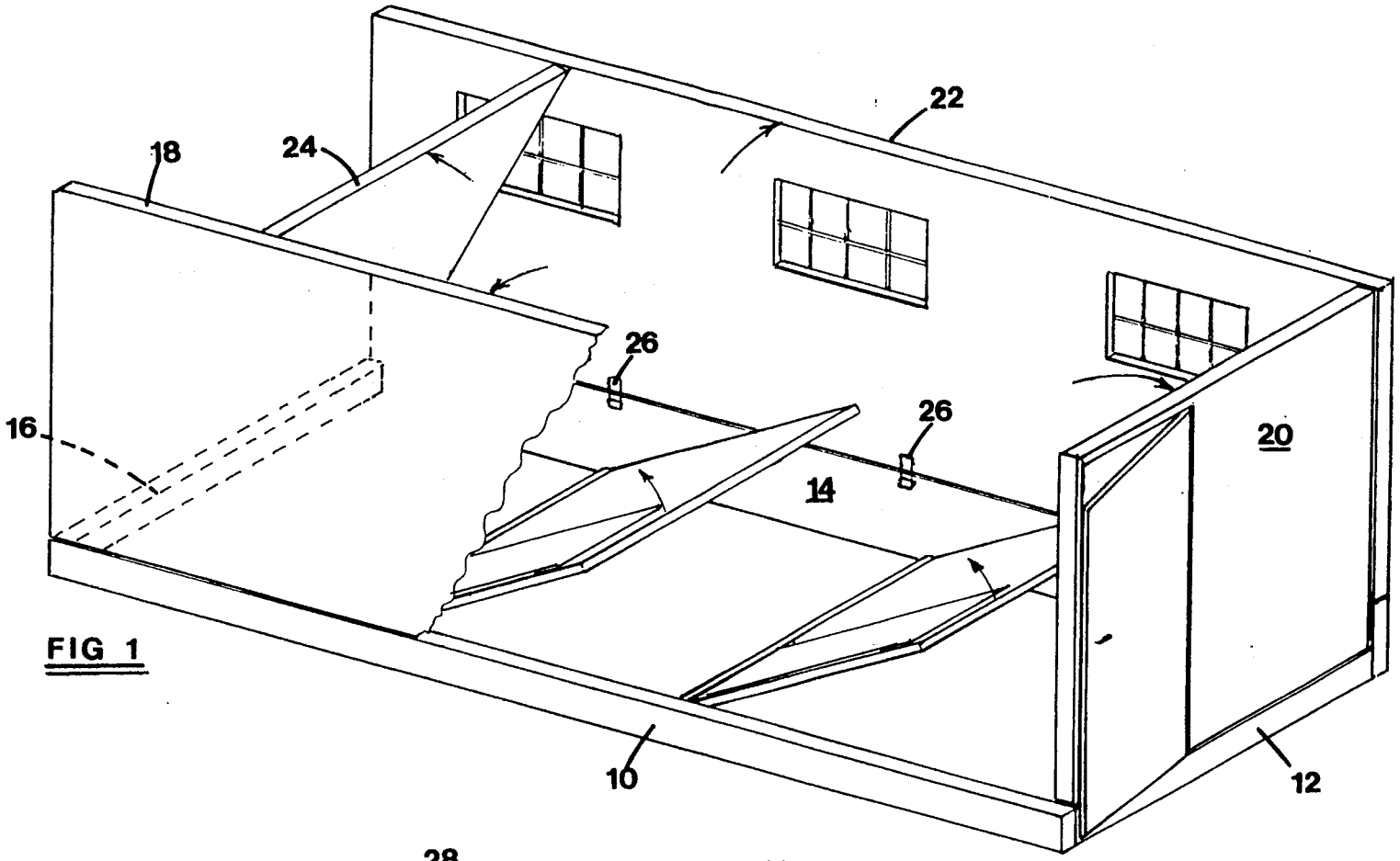
FIG. 1 is a pictorial isometric view of a hut according to the invention in a semi-erected condition.

In the drawings a unit for a hut, kiosk, or other accommodation includes base elements 10,12,14 and 16 each being of progressively greater heights. In its application for containers, the first base element is below the level of the floor thereof, the next and the other two at progressively higher locations.

Figure 2:
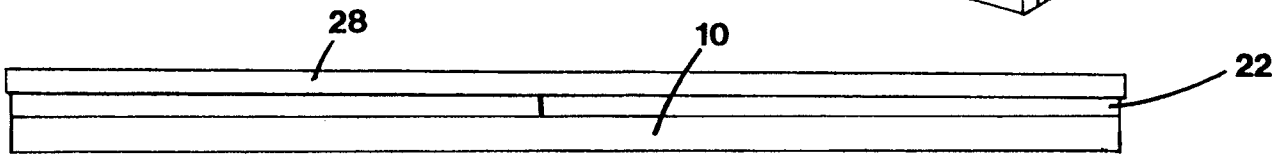
FIG. 2 is a side view of the collapsed unit.

The base elements have walls 18,20,22 and 24 (comprising peripheral angle iron members (not shown for illustrative purposes) with panels hinged thereto by means of recessed hinges 26. The walls are shown in FIG. 2 in overlapping relationship for transport purposes, a roof element 28 completing the assembly, the roofing element having pins (not visible) engaging in corresponding holes in the peripheral angle irons. It will be appreciated that a great number of units may be transferred at a time. At site, the units are off-loaded and each is located on prepared flat ground which may be concreted. The walls are then raised in turn as shown by the arrows in FIG. 1 and are secured in their upright position. For this purpose the top edges of the walls include a channeled or square tubular frame (preferably of galvanised iron) or angle iron so that the downwardly-depending pins of the roof element 28 may be lowered hereinto to secure the walls in their vertical position.

Additional frame members may be provided to provide for window and door frames which, if of metal, may be welded in position. These are shown in FIG. 1.

The panels may be galvanised corrugated iron, particle board or any other suitable sheet of material.

Figure 3:
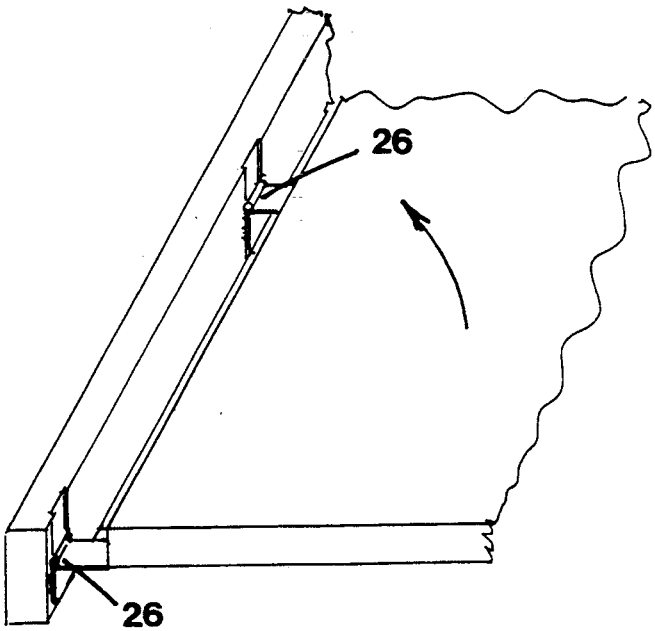
FIG. 3 is an isometric view of a portion of a base element and wall illustrating a hinge concept.
Figure 4:
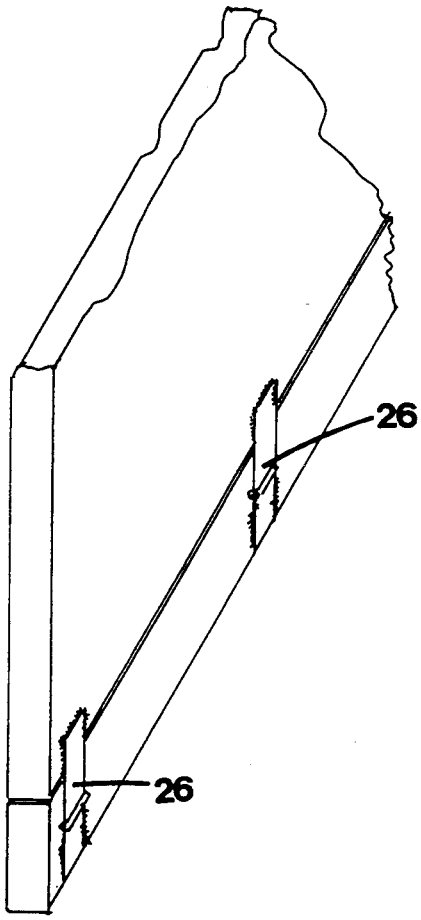
FIG. 4 is a similar view showing the wall in vertical position.

FIGS. 3 and 4 show a typical hinge 26 for the invention which is recessed into the base member and the hinge pivot is offset so as to allow the erected panel to be aligned with the base member when in the vertical position.

FIGS. 5, 6 and 7 illustrate a container according to the invention in which FIG. 5 is a plan view. The ends 36 and 38, and two sides 40 and 42 are hinged to a common base member or frame 43. The pivot lines 44 are shown in FIGS. 6 and 7 in which arrows indicate the articulation of the panels. A roof element 45 is shown in FIG. 7 which may be attached to the erected sides to form a box structure. It has been found that five or six of these containers in their collapsed condition may be transported in the same space as a single full container, which will be apparent to the reader as a significant advantage.

Figure 8:
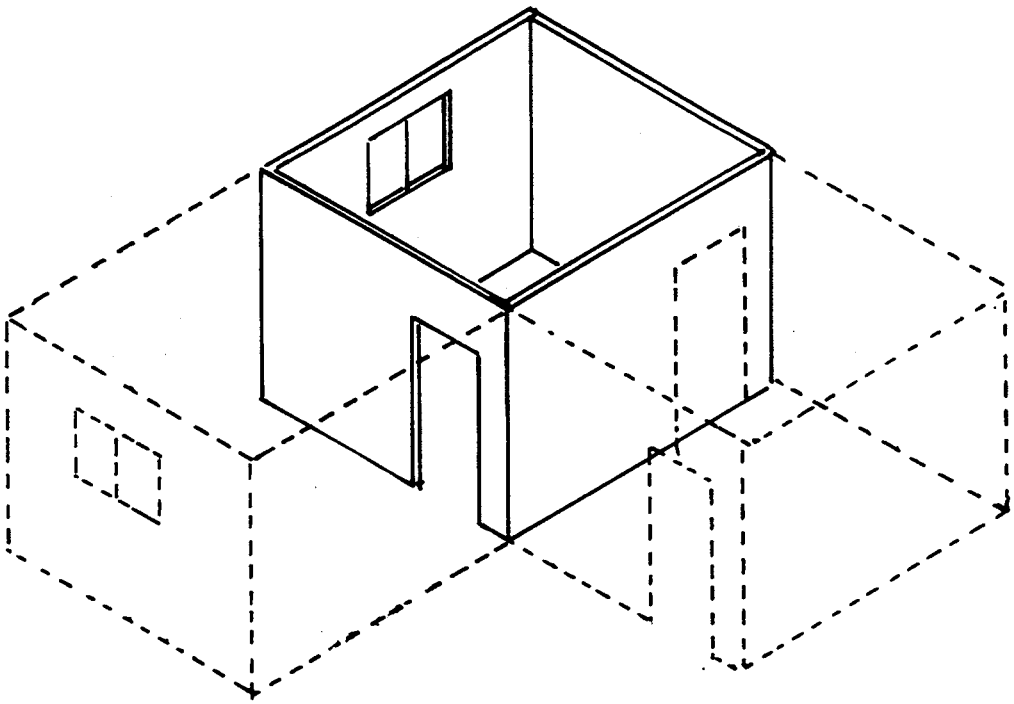
FIG. 8 is an illustration of several units according to the invention, joined together.

Returning to the housing units, it will also be appreciated that a large number of possibilities exist for joining units to form multi-united accommodations and an indication of some of the possibilities is illustrated in FIG. 8 which is self-evident.

I claim:

1. A foldable unit for an enclosure comprising a plurality interconnected of base elements of differing heights, each of said base elements having a wall hinged thereto in overlapping relationship when said walls are folded relative to said plurality of base elements; and means to secure the walls in an erected enclosure-forming structure when said walls are unfolded relative to said plurality of base elements.

2. The unit of claim 1, wherein the base elements differ in height from each other in accordance with the thickness of the walls.

3. The unit of claim 1, wherein the walls are of the same thickness and the base elements increase progressively in height.

4. The unit of claim 1, wherein the enclosure forms a container when said walls are in said erected enclosure-forming structure.

5. The unit of claim 1, wherein the enclosure forms a housing unit when said walls are in said erected enclosure-forming structure.

6. The unit of claim 1, wherein the walls have edges which include formations, further comprising a roofing member having means for engaging with formations so as to secure said roofing member to said walls, when said walls are in said erected enclosure-forming structure.

7. The unit of claim 6, wherein said formations comprise pin and socket elements.

* * * * *